United States Patent [19]

Jud

[11] Patent Number: 4,658,963

[45] Date of Patent: Apr. 21, 1987

[54] PACKAGE WITH WEAKENED PORTION FOR OPENING

[75] Inventor: Wilfried Jud, St. Pölten, Austria

[73] Assignee: Folienwalzwerk Bruder Teich Aktiengesellschaft, Obergrafendorf, Austria

[21] Appl. No.: 724,008

[22] Filed: Apr. 17, 1985

[30] Foreign Application Priority Data

Apr. 20, 1984 [AT] Austria ..... 1333/84

[51] Int. Cl.[4] ..... B65D 5/54; B65D 17/34; B65D 85/60

[52] U.S. Cl. ..... 206/632; 206/622; 206/633; 206/630

[58] Field of Search ..... 206/484, 441, 633, 620, 206/631, 623, 630, 624, 491.1, 632, 629, 622; 229/87 F, 87 C, 87 R, 43

[56] References Cited

U.S. PATENT DOCUMENTS

| | | | |
|---|---|---|---|
| 2,296,951 | 9/1942 | Rosen et al. | 206/623 |
| 2,946,435 | 7/1960 | Schladermundt et al. | 206/441 |
| 2,973,087 | 2/1961 | Rohdin | 206/631 |
| 3,156,352 | 11/1964 | Hayhurst | 206/219 |
| 3,166,234 | 1/1965 | Amberg | 206/633 |
| 3,392,901 | 7/1968 | Krzyzanowski | 206/622 |
| 3,451,539 | 6/1969 | Wysocki | 206/620 |
| 3,456,867 | 7/1969 | Kepko | 206/631 |
| 3,472,369 | 10/1969 | Schuster | 206/613 |
| 3,623,653 | 11/1971 | Work | 206/631 |
| 4,290,526 | 9/1981 | Haiss | 206/624 |
| 4,343,402 | 8/1982 | Holmström | 206/622 |

FOREIGN PATENT DOCUMENTS

| | | | |
|---|---|---|---|
| 2458462 | 6/1976 | Fed. Rep. of Germany | 229/87 F |

*Primary Examiner*—William Price
*Assistant Examiner*—Brenda J. Ehrhardt
*Attorney, Agent, or Firm*—Bierman & Muserlian

[57] ABSTRACT

A package for packaging solid products with a wrapping formed from a flat, foldable packaging material and provided with a means to aid in opening the wrapping, the wrapping having a strip-shaped lamination segment of the packaging material formed by two layers of the packaging material joined together by a strip-shaped bonding segment, perforations and/or material weaknesses being provided in the strip-shaped bonding segment (15,20,26,32) as the means to aid opening situated in one of the two layers (11,18,27,33) of the lamination segment (2,17,25,31).

9 Claims, 9 Drawing Figures

PACKAGE WITH WEAKENED PORTION FOR OPENING

STATE OF THE ART

Solid products, especially those divided or capable of being divided into several parts like a candy bar are normally packaged in a wrapper of packaging material made from a flat, foldable material and are sometimes provided with a means to aid opening the same.

Wrappers with a lamination segment of the packaging material may be tubular bag packages or full-wrap packages with envelope folds and such wrappers are often used for packaging food products, e.g., long shelf-life baked goods, but also chocolate or candy bars. Tubular bag packages in particular, on which lamination segments appear in the form of fins of the wrapper created by longitudinal and/or cross sealing-seams, can be produced on relatively simple packaging machines with high throughput, and they also have the advantage over other types of packaging, such as single-wrap packages, in that through the simple formation of the longitudinal and/or cross sealing-seams their cover can be made essentially gas-tight, which results in improved durability of the packaged product.

It is known that in tubular bag packages as well as in full-wrap packages a tear-strip is provided as an opening aid, the beginning of which is usually situated at a lamination segment of the packaging material, e.g. at a sealing seam of the package-wrapper which makes it difficult to render such packages completely gas-tight.

A gas-tight wrapper of this type is described in commonly assigned U.S. patent application Ser. No. 261,157 filed Apr. 20, 1981 and in this wrapping which is advantageously in the form of a tubular bag package, the packaging material has a lamination segment formed by two layers joined together flatly with the aid of a bonding agent and at which the beginning of the tear-strip is situated. Through weakening lines arranged in a particular manner in said lamination segment on the packaging material, an unproblematic actuation of the tear-off device is made possible while retaining the impermeability to gas of the package-wrapper.

OBJECTS OF THE INVENTION

It is an object of the invention to provide an essentially gas-tight wrapper with two layers joined together by a strip-shaped bonding segment without any special tear strip for opening.

It is another object of the invention to provide an essentially gas-tight package which can be easily opened with little effort and provided with an opening means which does not impair the gas impermeability.

These and other objects and advantages of the invention will become obvious from the following detailed description.

THE INVENTION

The novel package of the invention for packaging solid products comprises a wrapping formed from a flat, foldable packaging material and provided with a means to aid in opening the wrapping, the wrapping having a strip-shaped lamination segment of the packaging material formed by two layers of the packaging material joined together by a strip-shaped bonding segment, perforations and/or material weaknesses being provided in the strip-shaped bonding segment (15,20,26,32) as the means to aid opening situated in one of the two layers (11,18,27,33) of the lamination segment (2,17,25,31). The provision of the opening aid means in one of the two layers of the strip-shaped bonding segment by perforations and/or material weaknesses in solves the prior art problems.

In an advantageous embodiment of the package of the invention, the bonding segment provided with perforations and/or material weakness in one of its layers is a fold formed in the packaging material starting at the surface of the package-wrapper. In another advantageous embodiment of the package of the invention, it is a tubular bag package in which the lamination segment which has perforations and/or material weakness in one of its two layers, is the lamination segment of the longitudinal sealing seam or of one of the cross sealing seams of the package.

In a further advantageous embodiment of the package of the invention, the perforations and/or material weaknesses are at a minimum distance of more than 1 mm from the edges of the strip-shaped bonding segment. According to advantageous embodiments of the package of the invention, the layers of packaging material in the bonding segment are bonded to each other by a cold-sealing bonding agent or by heat-sealing.

According to another advantageous embodiment of the invention, the package of the invention for which a multilayer packaging material is used is characterized in that the material weaknesses applied to one of the two layers of packaging material in the bonding segment form a weakening line which is formed in the packaging material so that a carrier layer, which is a part of the packaging material thickness and is covered by an unperforated but easy tearible surface layer, is provided with linear perforations.

Referring now to the drawings.

Figure 1:
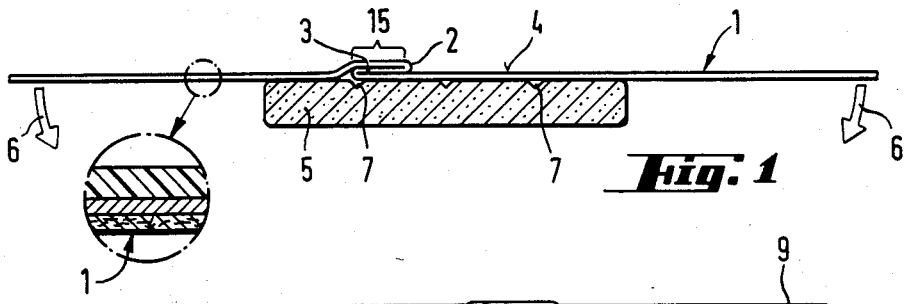
FIGS. 1 and 2 show the same embodiment with FIG. 1 showing an early production phase and FIG. 2 showing the perspective view of the final package.
Figure 2:
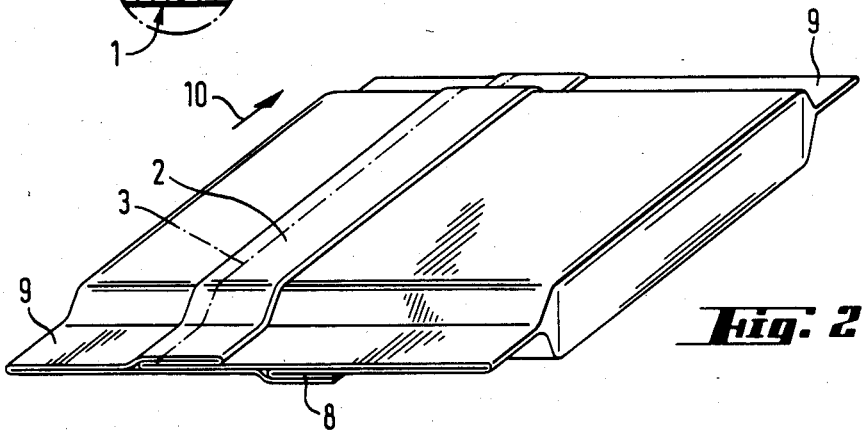

In FIGS. 1 and 2 in the packaging machine, a fold 2 is continuously formed in a length of packaging material 1 pulled off the reel and is provided with a sealing layer applied in profile on one side whereby the two layers of packaging material forming the lamination segment of fold 2 are bonded together along the entire width of the fold by sealing of profile sealing layers present at this place. The packaging material length has in its longitudinal direction (perpendicular to the plane of the drawing in FIG. 1) a weakness line 3 which comes to lie in fold 2. If necessary, these weakness lines can also be applied by a suitable device directly on the packaging machine, immediately prior to producing the fold. The fold 2 is then reversed onto the plane of the length of packaging material 1 so that the layer of packaging material within which the weakness line 3 is situated will adjoin the surface 4 of packaging material length 1.

The length of packaging material 1 thusly provided with a longitudinal fold 2 is now (see FIG. 1), to form a packaging material tube, wrapped in the usual manner around the successively fed items to be packaged, e.g., chocolate bars 5 in the direction of arrows 6 with the course of the length of packaging material 1 running so that fold 2 will start at a predetermined spot on the length of packaging material 1, e.g., in the area of a dividing notch 7 of a chocolate bar.

The finished packaging material tube is finally formed from the length of packaging material 1 wrapped around chocolate bars 5 in that a longitudinal sealing seam is produced and that said tube, after the longitudinal sealing seam is reversed, is provided with two cross-sealing seams running parallel to each other between each two successive bars of chocolate, and divides into individual tubular bag wrappings by separating cuts between said two cross-sealing seams. On the individual wrapping illustrated in FIG. 2, the reversed fold 2 can be seen as well as the reversed longitudinal sealing seam 8, the course of the weakness line 3, and the cross-sealing seams now forming the fins 9 of the tubular bag wrapping.

Figure 3:
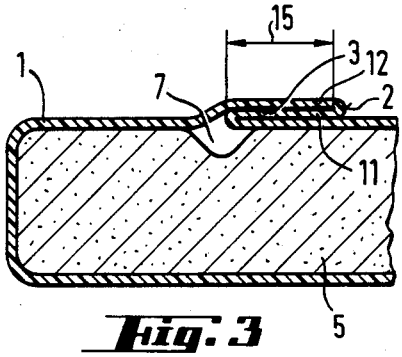

FIG. 3 illustrates the wrapping on a somewhat enlarged scale in a section along a plane perpendicular to the direction 10 of FIG. 2, in a partial illustration containing fold 2. The fold 2 forms a lamination segment of the packaging material with two layers 11 and 12, with layer 11 which adjoins the surface of the wrapping containing the weakness line 3, which line consists either of several linear perforations successively arranged and separated from each other along the course of the weakness line, or of a continuous linear slit ending shortly before the ends of the cross-sealing seams.

Opening of the package will now be described in detail with the aid of FIGS. 4 and 5 which show two different phases of the opening operation. To open the package, it is held with the hands at both sides of fold 2 and snapped off along an axis within the wrapping running below the dividing notch 7 of the chocolate bar of FIG. 3 and parallel to it, while simultaneously breaking the chocolate bar 5 so that fold 2 will come to lie on the outside of the crack (see FIG. 4). As indicated by the arrows 13, tensile stress is created at both sides of fold 2 in the wrapper, which has the effect that the two packaging material layers 11, 12 forming the fold 2 are peeled off from each other severing the seal-joint while progressively snapping the wrapping starting from the inside of the package. This continues until this severing reaches the perforations provided in the layer of packaging material 11 along line 3, whereupon the package, tearing the bridges of material between the perforations, snaps open approximately as far as shown in FIG. 5. In the course thereof, the packaging material layer 11 torn along line 3 will have formed a slot-shaped opening 14 in the package-wrapper (FIG. 5), through which the packaged item can be removed from the wrapping.

In the above described wrapping, for example, a three-layer packaging material is used which starting from the outside of the wrapping, consists of a film of biaxially stretched polypropylene (OPP) 0.012 to 0.020 mm thick, aluminum foil 0.007 to 0.009 mm thick, a paper weighing 20 to 60 gsm [g/m$^2$], and a cold adhesive coating on a latex basis (2 to 7 gsm [g/m$^2$] solid substance) preferably applied in profile.

According to another advantageous embodiment of the package of the invention, the packaging material layer 11 has no perforations along line 3, but rather material weaknesses which form a weakening line. Suitable packaging material in which such weakness lines with reproducible weakening of the material can be provided advantageously have a multilayer structure and consist of at least one carrier layer and one surface layer, wherein the carrier layer covered by the unbroken surface layer is provided with a perforation or with a series of linear perforations separated from each other along the provided weakness line. A packaging material with a two-layer structure suitable for this consists starting from the package surface, of a paper weighing 20 to 50 g/m$^2$ as carrier layer, aluminum foil 0.007 to 0.009 mm thick as surface layer, a subsequent cold adhesive coating on a latex basis (2 to 7 g/m$^2$). According to an advantageous variant, an OPP film 0.020 to 0.40 mm thick can be used instead or in addition to the paper in the carrier layer.

Figure 4:
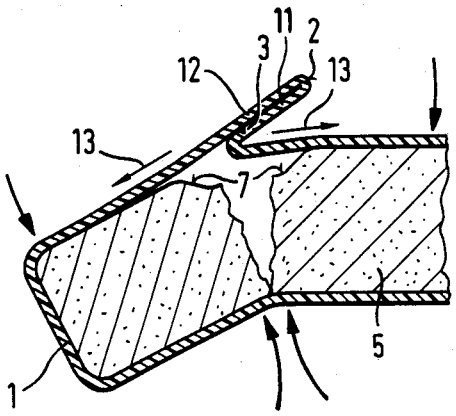
FIGS. 3 to 5 are partial cross-sectional views of FIG. 2 illustrating the opening operation of the package.
Figure 5:
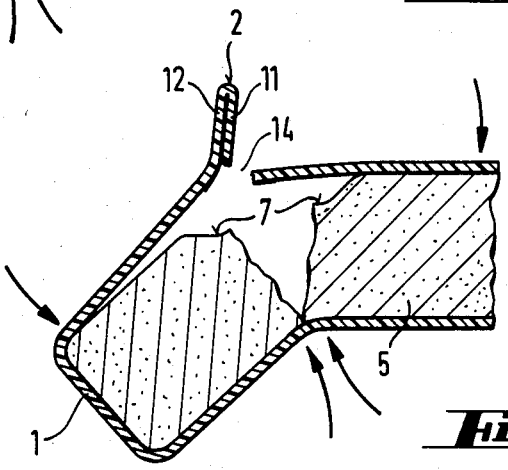

The opening of the package is effected in the same manner as described in FIGS. 3 to 5. When the severing of the cold seal joint between layers 11,12 of fold 2 reaches the weakness line arranged along line 3 by virtue of the snapping off of the package, the weakness lines tear open whereby in its place a slot-shaped opening 14 is formed in the package wrapper through which the packed product can be removed. In place of the cold adhesive coating, a heat-sealing layer may be used in the wrapping of FIG. 3.

The distance of the perforations and/or material weaknesses from the edge inside the package of the bonding segment occupying the entire width of the fold should advantageously be at least 1 mm, i.e., it should be wide enough that these perforations and/or material weaknesses are situated with certainty within the bonding segment 15 (see FIG. 1 and FIG. 3), even in cases of inaccuracies in the production of the wrapping.

Figure 6:
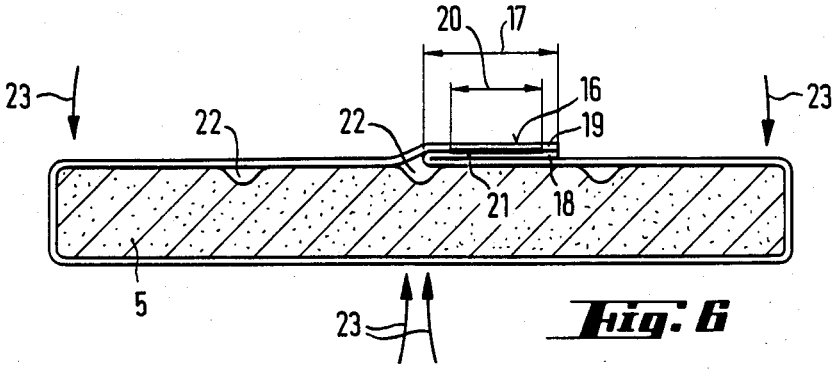
FIGS. 6 to 9 illustrate three additional embodiments of the packages of the invention.

FIG. 6 shows in a schematic cross-section a further advantageous variant of the package of the invention in the form of a tubular bag package. In this package, the longitudinal sealing seam 16 reversed onto the surface of the package forms a lamination segment 17 of the packaging material with two layers of packaging material 18, 19 which are joined to each other by a strip-shaped bonding segment 20 by a cold sealing bonding agent. As thus far described, the package of FIG. 6 corresponds to the known tubular bag packages but according to the invention, several linear perforations, separated from each other, are now provided in one of the layers of the lamination segment 17, in the embodiment shown, in the layer 18 adjoining the surface of the package wrapper within the bonding segment 20 along line 21. In addition, the longitudinal sealing seam 16 forming the lamination segment 17 is arranged so that it starts at the package at a dividing notch 22 of a chocolate bar. Opening of the package is effected by snapping the package in the direction of the arrows 23, similar to what has been described in FIGS. 4 and 5.

The package of FIG. 6 is distinguished by its particular simplicity, but does not have the wide-ranging variation possibilities as the wrapping described in FIGS. 1 to 5. For example, it is appropriate to arrange the longitudinal sealing seam of a tubular bag package in a center area of the package's front surface, since its arrangement in the vicinity of the package edge would cause production engineering problems. In addition, the creation of the longitudinal sealing seam is done mostly with the aid of a sealing device in the form of a driven pair of sealing rollers which simultaneously with the sealing process also effects the advancing of the packaging material tube. To be able to transfer the necessary feeding force from the pair of sealing rollers to the packaging material tube, the longitudinal sealing seam mostly has a width greater than would be necessary for creating a gas-tight sealing joint. The fold 2 forming the packaging material lamination segment of FIGS. 1 to 5, however, can be arranged at practically any desired location on the surface of the package wrapper, and in most cases its width can be smaller than that of the lamination segment of a longitudinal sealing seam of a tubular bag package.

Figure 7:
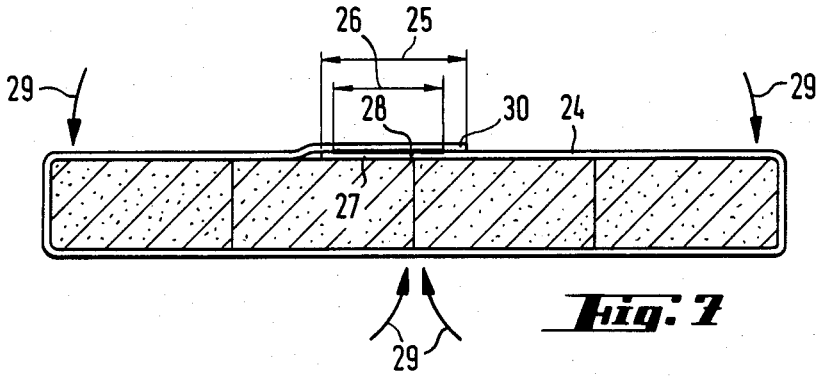

FIG. 7 is a schematic cross-section of a wrapper-package for long self-life baked goods in which the packaging material 24 forms a lamination segment 25, within which two layers of packaging material are joined together in a strip-shaped bonding segment 26 by a coating of a cold or heat-sealing bonding agent. The inner layer 27 of the packaging material of lamination segment 25 has a weakness line 28 running in a direction perpendicular to the plane of the drawing. By snapping the package in the direction of arrows 29, the bond in the bonding agent joint between the weakness line 28 and the edge 30 of bonding segment 26 on the outside of the wrapping is peeled off, and the packaging material layer 27 is torn open along weakness line 28 whereby, similar to what is shown in FIG. 5, a slot-shaped opening is formed in the package for removing the packed product.

Figure 8:
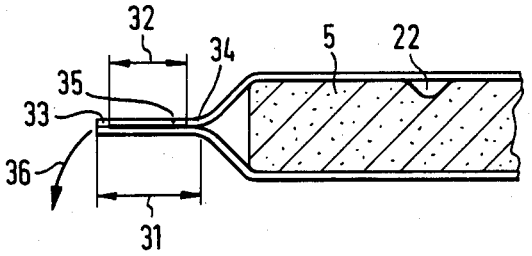
Figure 9:
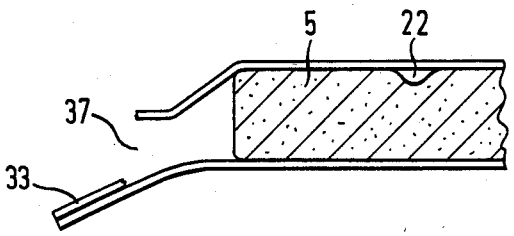

A package that is not opened by snapping is described below in FIGS. 8 and 9 which show, in a partial cross-section view each, one end of a tubular bag package for chocolate before and after opening, respectively. At the end of the tubular bag package of FIG. 8, a lamination segment 31 is provided which, as is customary in tubular bag packages, is shaped as a fin by means of a cross-sealing seam. In lamination segment 31, two layers of packaging material are bonded together within a strip-shaped bonding segment 32 by a layer of a sealing bonding agent. In the upper packaging material layer 33, a weakness line 35 is arranged near the edge 34 of the bonding segment 32 on the inside of the package. To open the package, the fin is held and pulled in the direction of arrow 36 whereby the bond in the bonding agent joint is peeled off between the weakness line 35 and the edge 34, and the layer 33 of packaging material is torn open along weakness line 35 by virtue of which an opening 37 is formed for the removal of wrapped product as shown in FIG. 9.

Various modifications of the packages of the invention may be made without departing from the spirit or scope thereof and it should be understood that the invention is intended to be limited only as defined in the appended claims.

What I claim is:

1. A package for packaging solid products with a wrapping formed from a flat, foldable packaging material and provided with a means to aid in opening the wrapping, the wrapping having a strip-shaped lamination segment of the packaging material formed by two layers of the packaging material joined together by a strip-shaped bonding segment located therebetween, a weakness line provided on one of the two layers within the region joined by the strip-shaped bonding segment (15,20,26,32) as the means to aid opening, the weakness line extending in the longitudinal direction of the strip-shaped bonding segment (15,20,26,32) and composed of perforation in said one of the two layers.

2. The package of claim 1 wherein the lamination segment provided with perforations and/or material weakness in one of its layers is a fold (2) formed in the packaging material (1) on the wrapping surface.

3. The package of claim 1 wherein the package is a tubular bag package and the lamination segment (17,31) provided with perforations and/or material weakness in one of its two layers (18, 33) is the lamination segment of the longitudinal sealing seam (16) of the package.

4. The package of claim 2 wherein the package is a tubular bag package and the.lamination segment (17,31) provided with perforations and/or material weakness in one of its two layers (18,33) is the lamination segment of the cross-sealing seams of the package.

5. A package of claim 1 wherein the perforations and/or material weakness are at a minimum distance of more than 1 mm from the edges of the strip-shaped bonding segment (15,20,26,32).

6. A package of claim 1 wherein the layers of packaging material in the bonding segment are joined together by a cold sealing bonding agent.

7. A package of claim 1 wherein the layers of packaging material in the bonding segment are joined together by heat-sealing.

8. A package of claim 1 wherein perforations are applied to one of the two layers of packaging material (11,18,27,33) in the bonding segment (15,20,26,32) and consist of a linear perforation or of several linear perforations arranged along a line, but separate from each other.

9. A package of claim 1 using a multilayer packaging material wherein said weakness line is formed in the packaging material which includes a carrier layer covered by an unbroken surface layer and constituting a part of the thickness of the packaging material, said carrier layer being provided with linear perforations along the weakness line.

* * * * *